United States Patent [19]

Levenson

[11] 3,953,313

[45] Apr. 27, 1976

[54] ELECTROLYTIC CELL AND ELECTRODE THEREFOR

[75] Inventor: Gerald I. P. Levenson, Middlesex, England

[73] Assignee: Eastman Kodak Company, Rochester, N.Y.

[22] Filed: Mar. 6, 1975

[21] Appl. No.: 555,765

Related U.S. Application Data

[63] Continuation of Ser. No. 370,500, June 15, 1973, abandoned.

[30] Foreign Application Priority Data

June 30, 1972 United Kingdom ..... 30782/72

[52] U.S. Cl. ..... 204/267; 204/109; 204/269; 204/284; 204/286; 204/294

[51] Int. Cl.[2] ..... B01K 1/00; C25B 9/02

[58] Field of Search ..... 204/109, 275, 281, 284, 204/286, 294, 267, 269, 268

[56] References Cited

UNITED STATES PATENTS

| | | | |
|---|---|---|---|
| 585,959 | 7/1897 | Kellner | 204/268 |
| 756,328 | 4/1904 | Christy | 204/284 X |
| 799,061 | 9/1905 | Kellner | 204/286 X |
| 883,170 | 3/1908 | Christy | 204/268 X |
| 896,555 | 8/1908 | Landis | 204/268 |
| 1,629,212 | 5/1927 | Giffen | 204/109 |
| 2,563,903 | 8/1951 | Zadra | 204/109 X |

OTHER PUBLICATIONS

R. Hand et al., "The Carbon Cloth Electrode", *Jrnl. Electrochem. Soc.*, (Jan., 1972), Vol. 119, No. 1, p. 74.

*Primary Examiner*—John H. Mack
*Assistant Examiner*—A. C. Prescott
*Attorney, Agent, or Firm*—H. M. Chapin

[57] ABSTRACT

An electrolytic cell for recovering silver from photographic processing solutions comprising an assembly of two or more spaced electrodes which are mounted on support rods and carried within a perforate or imperforate housing. Each electrode comprises a support member such as a frame, one or more sheets of porous flexible material carried by said support member, and a plurality of filaments of electrically conductive material such as carbon distributed across the area of the sheet or sheets, and captured between a sheet and the support member, or between two sheets. The entire electrolytic cell can be formed of combustible materials, and the deposited silver can be recovered after burning the cell.

10 Claims, 3 Drawing Figures

ELECTROLYTIC CELL AND ELECTRODE THEREFOR

This is a continuation of application Ser. No. 370,500 filed June 15, 1973 now abandoned.

BACKGROUND OF THE INVENTION

1. Field of the Invention

The present invention relates to electrolytic cells for the recovery of metals from solutions containing metal ions, particularly photographic processing solutions containing silver ions.

2. The Prior Art

In general, recovery cells of the above type comprise a container for the solution containing metal ions which forms the electrolyte. A pair (or pairs) of electrodes is located in the container in such a position as to be immersed in the electrolyte in use. One of the electrodes is arranged to be the cathode and the other is arranged to be the anode of the cell.

In use, a D.C. potential from a suitable source is applied across the electrodes and the metal ions are caused to migrate to the cathode where they are discharged and converted to metal atoms which generally adhere to the cathode. When sufficient metal has deposited on the cathode it is usually taken from the cell and the deposit removed therefrom, after which the cathode is replaced in the cell. The cell may be arranged to operate in a batchwise manner in which case electrolysis is continued until the concentration of metal ions in the cell is depleted down to a predetermined level, at which point the electrolysis is discontinued and the depleted solution replaced by a fresh solution. Alternatively, the cell may be arranged to operate in a continuous manner in which case the electrolyte is continually passed through the cell from an inlet to an outlet at a predetermined rate. The rate of passage of the electrolyte through the cell is such that a satisfactory proportion of the metal ions in the solution are discharged and converted to metal atoms at the cathode.

Prior art metal recovery cells require that the metal be recovered from the cathode of such cells by expensive and complicated chemical or mechanical means. Furthermore, in cells using planar cathodes the recovered metal would sometimes flake off, causing a short circuit.

The instant invention has solved the above problems of prior art metal recovery cells, by providing a cell in which the metal can be removed from the cathode of the cell by the simple process of combustion. An auxiliary advantage of the invention is that the recovered metal forms a granular deposit on the cathode of the cell, so that short circuits due to flaking are not likely to occur.

SUMMARY OF THE INVENTION

According to the present invention there is provided an electrolytic cell for recovering metals from solutions containing metal ions, which comprises a housing containing an anode and a cathode, at least one of the electrodes, desirably both, comprising a non-metallic substrate including electrically conductive fibrous material such as carbon fibres.

Further, the housing may be in the form of an expendable self-contained cartridge enclosing the electrodes. In this embodiment of the present invention each electrode is provided with an electrical terminal which extends through a wall of the cartridge and is arranged to be connected to a D.C. potential source. In this embodiment of the present invention, the electrolytic cell can be sold as a complete unit for insertion into a metal recovery apparatus. When sufficient metal has been deposited in the cell the complete unit can be removed from the recovery apparatus and a replacement unit inserted therein. Still further, if the components of the cell including the cartridge and the substrates for the anode and cathode are formed of combustible material the cell can be incinerated without any prior dismantling and the deposited metal thereby recovered.

The electrolytic cell of the present invention has been found to be particularly useful for the recovery of silver from used photographic processing solutions such as fix solutions.

The anode and cathode may each be in the form of a natural or synthetic plastics material substrate, such as a cellulose material, polyethylene terephthalate, polyethylene, polystyrene, polyvinyl chloride, polypropylene, or phenol formaldehyde resin, bearing a layer of electrically conductive material. Conveniently, the plastics substrate material is sufficiently thin to be flexible and a thickness of the order of 100 microns has been found to be satisfactory.

In a preferred embodiment of the present invention, either or both of the electrodes comprises a non-metallic substrate including carbon fibre as the electrically conductive material.

Generally, carbon fibre is in the form of graphitic threads formed by carbonizing heat-treatment of organic polymers such as polyacrylonitrile. One such commercially available material is "Grafil" (trademark) sold by Courtaulds Limited in the form of a tow or yarn of 5,000 to 10,000 filaments of 8–9 microns mean diameter. Each "Grafil" filament has a resistance of about 4,000 ohms per cm. An equivalent carbon fiber is sold by Hercules Incorporated under the trademark "Magnamite." This fiber has the same filament size and filament resistance, as "Grafil" described above.

Conveniently, the electrode may be made by sandwiching a layer of the carbon fibres tow spread out over a great area, between two layers of a solution-permeable material which form the substrate. Preferably, the solution permeable material is an open-mesh flexible material such as a non-woven fabric having high wet strength, for example, perforate and porous tea-bag paper or paper towelling such as "J-cloth" (trademark) sold by Johnson and Johnson Limited. Preferably, the two layers of fabric are stitched together intermittently across their surfaces to provide for convenient handling and to hold the carbon fibres in place. The layers of solution permeable material may be held on a frame to make the electrode more rigid.

Alternatively, the substrate may be solution impermeable, such as a plastics material as described hereinabove. In this case the substrate bears a layer of a solution permeable binder holding the carbon fibres, eg. gelatin.

The carbon fibre may be used in the form of a felt, optionally containing fibres of material such as textile fibres such as cotton, nylon, polyester, or the like as reinforcement. Alternatively, the tow or yarn may be spread out on the substrate and used in this form. In this case, it is preferred that there be substantial interlacing of the fibres to form an electrically conductive network. If the fibrous material felted with the carbon fiber is self supporting, no substrate is needed. If it is desired to utilize no support, the carbon fibers may be stiffened by weaving them together, or by applying a small amount of a plastic solution to serve to attach some of the fibers together.

Preferably, a pigtail of bunched carbon fibre tow is provided at one end of the electrode to enable an electrical connection to be made to the carbon fibre layer.

It has been found that the carbon fibre-containing electrodes are useful as both anodes and cathodes for the electrolytic recovery of silver from used photographic processing solutions.

According to the present invention, there is further provided an expendable assembly of a plurality of similar electrodes for use in the electrolytic cell of the present invention, comprising at least one anode and one cathode, each comprising a non-metallic substrate including an electrically conductive material as described above. Preferably, the substrates are combustible. Further, each electrode is provided with an electrical terminal which is mounted on the assembly and is arranged to be connected to a D.C. potential source.

According to the present invention there is also provided an electrode, particularly useful for electrolytic metal recovery, comprising a non-metallic substrate including a layer of carbon fibre.

It has been found that a cell according to the present invention can be used to recover silver from a photographic fixer containing more than 1 gram per liter of silver at currents of up to 30 amps per square meter without the need for any agitation of the electrolyte. However, at concentrations below 1 gram per liter of silver there is a possibility of sulphiding taking place unless the electrolyte is agitated or the current reduced.

The cell of the present invention can be made in a wide variety of configurations. Where the housing is in the form of a self-contained cartridge enclosing the electrodes, it may be sealed and liquid-tight and have an inlet and an outlet arranged to be connected up to a solution supply and a drain respectively. In this case the housing of the cell serves as a container for the electrolyte from which the metal is to be recovered.

Alternatively, the housing enclosing the electrodes may be in the form of a perforated cartridge arranged for insertion into an electrolyte container forming part of the metal recovery apparatus. Preferably, the perforations are made small enough to prevent an operator being able to gain access to and interfere with the electrodes. Conveniently, the housing is surrounded by an open-mesh material such as flexible porous tea-bag paper which retains any metal particles which may fall from the cathode, for example when the cartridge is being replaced.

The housing of the cell can take many forms. For example, it can be in the form of a cylinder or a box. The housing of the cell may contain a single anode and a single cathode in the form of open-ended concentric cylinders or sheets convoluted together, particularly where the housing is in the form of a cylinder. In the case where the electrodes are in the form of convoluted sheets having a plastics material substrate the cathode has an electrically conductive layer on both of its surfaces. Preferably, in this embodiment of the invention the cathode is perforated to enable the silver deposited on the two surfaces to become bonded together. Similarly, the anode has an electrically conductive layer on both sides. Alternatively, the substrate can be in the form of a perforated sheet with the electrically conductive layer on one side thereof.

Further, a plurality of flat anodes and cathodes can be interdigitated in substantially parallel relationship to one another, or the cell can contain a single anode and a single cathode in opposed relationship to one another.

In another embodiment of the present invention, one or more cathodes comprising a non-metallic substrate including an electrically conductive material can be used in a cell which contains one or more anodes arranged to remain in the cell when the cathodes are removed and replaced.

The life of an electrolytic cell according to the present invention in the form of a self-contained cartridge can be defined in terms of the number of ampere-hours required to yield a satisfactory deposit of silver. Alternatively, the cell can be run until enough metal accumulates to short-circuit the electrodes. In this case means can be provided to switch off the apparatus in response to any of the changes of cell characteristics which occur. Alternatively, visual or audible alarm means can be provided to indicate when this has taken place.

The electrodes of the cell described above are less costly than silver or silver coated electrodes of the prior art, and are not brittle and breakable like solid graphite electrodes. Moreover, the cell is so constructed as to permit full recovery of deposited silver while preventing access of unauthorized persons to the silver in the cell.

THE DRAWINGS

The present invention will now be described further, by way of example, with reference to the accompanying drawings in which.

THE PREFERRED EMBODIMENTS

Figure 1:
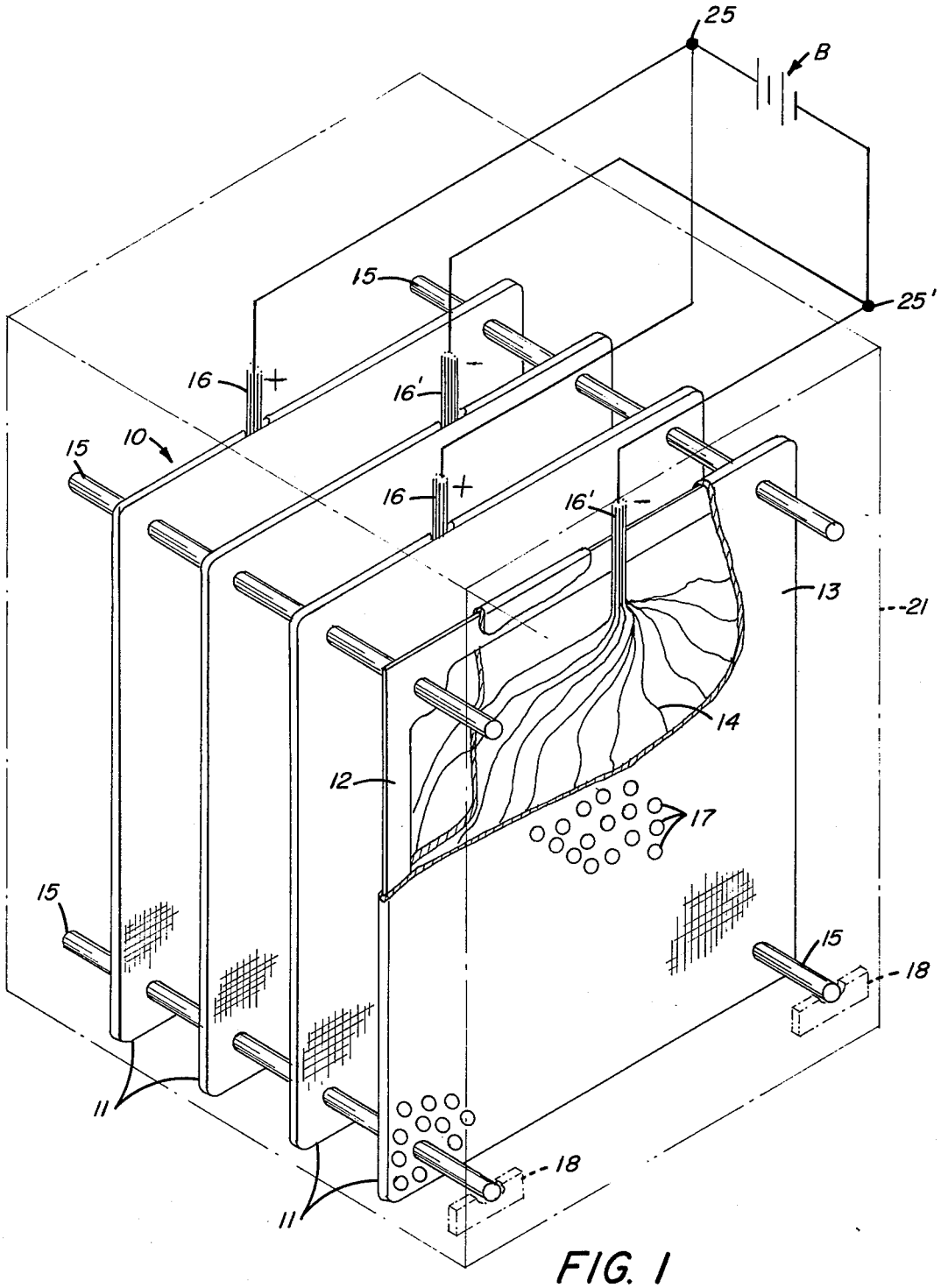
FIG. 1 is a perspective view partially broken away and in section, of an electrode assembly according to the present invention.

In FIG. 1 there is shown an electrode assembly 10 having four electrodes 11 which can be assigned at will to anodic or cathodic roles and connected or interconnected accordingly so that each electrode is a counter electrode to the next adjacent electrode or electrodes. The assembly can be carried within a cartridge or housing 21, as will be more fully described hereinafter.

Each electrode 11 comprises a light but fairly rigid hollow plastic frame 12 which serves to extend and support a double thickness of an open-mesh material such as J-cloth, which forms a substrate 13, including, as an electrically conductive material, a layer of strands of carbon fibre tow 14. The layer of carbon fibre tow 14 has been spread out to substantially cover the area of the substrate 13 bounded by the frame 12. The two layers of the substrate are tacked together in a few places by means such as spaced stitches to hold the spread out fibres substantially in place.

The open-mesh material or substrate 13 of each electrode contains a plurality of holes 17, only some of which are shown but which extend across its whole area.

The electrodes 11 are arranged to be supported and located with respect to each other by means of plastic rods 15, with at least the lower ones resting in saddles 18 in the four bottom corners of cartridge 21. Each of the carbon fibre tow layers 14 is formed into a pigtail 16 or 16' of different signs at one end which forms an electrical terminal in use. The positive pigtails 16 are joined at a terminal 25, and the negative pigtails 16' are joined at a terminal 25', both terminals being connected to a battery or other source of direct current B.

Figure 2:
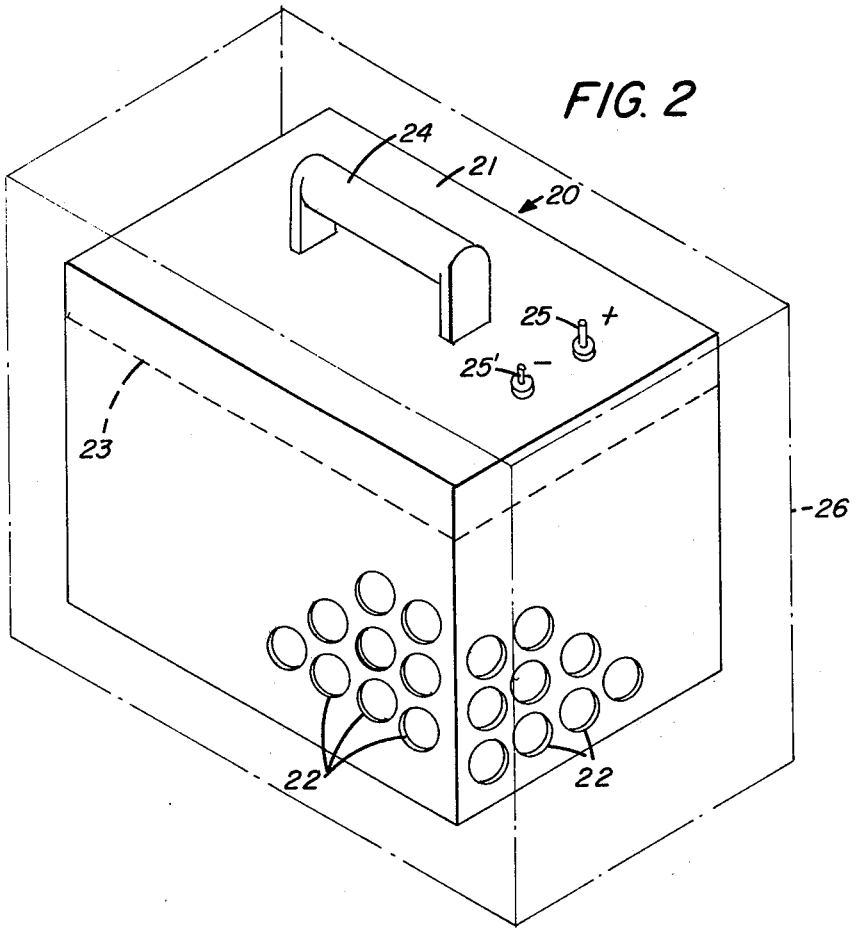
FIG. 2 is a perspective view of an electrolytic cell, having apertured walls for liquid access to the inside of the cell, adapted to be inserted into a tank of electrolyte such as used fixing solution in metal recovery apparatus.

In FIG. 2 there is shown an electrolytic cell 20 having a housing 21 in the form of an immersible cartridge containing an electrode assembly such as that shown in FIG. 1 as described above. The housing 21 contains perforations 22 around its sides, but not on the bottom. Only some of the perforations 22 are shown but it is to be understood that each side of the cartridge contains a plurality of the perforations 22. The perforations 22 are such as to allow free access of electrolyte by convection when the cell is immersed therein, while restraining manual interference with the electrode assembly. Although the bottom is not perforated it can conveniently have a hole to allow solution to drain away when the spent cartridge is lifted from a recovery tank or vessel 26 containing electrolyte. The level to which the cartridge is arranged to be immersed is shown by a broken line 23. The line 23 is at a safe level below a pair of electrical contacts 25, 25' of different signs and is defined by the height of the overflow from the recovery tank 26 with which the cell is to be used. It is important that free emergence of the electrolyte from the cartridge through the perforations 22 be allowed at this level since in the case where the electrolyte is used photographic fixer, for example, the desilvered solution rises to the top by convection.

Preferably, the recovery tank 26 with which the cartridge is intended to be used is a rectangular vessel a little larger in internal dimensions than the cartridge.

In use, the electrolyte is admitted at or is led to or is allowed to reach the bottom of the tank 26 without deliberate intermixing with the solution already present in the tank. The electrolyte demetallized at the cathode rises by convection and is drained from the recovery tank at the height of the surface at a point far from the inlet. For convenience, a handle 24 is provided to enable the cartridge to be inserted into and removed from the recovery tank easily.

Figure 3:
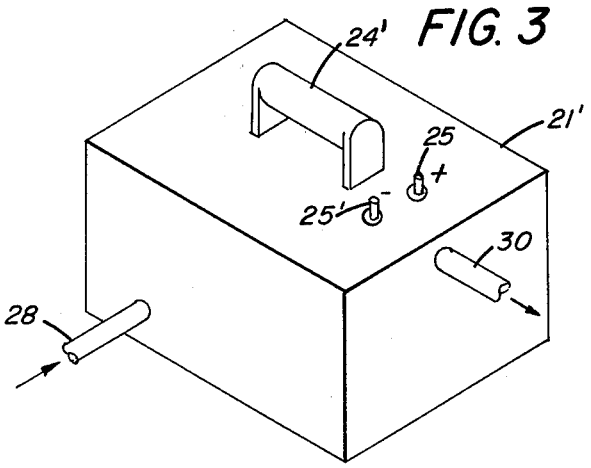
FIG. 3 is a perspective view showing another modification of the electrolytic cell, having provision for passing a flowing stream of electrolyte through the cell.

In an alternative embodiment of the present invention, shown in FIG. 3, the housing 21' of the electrolytic cell is a sealed and liquid-tight cartridge having a handle 24'. In use electrolyte is led into and out of the cartridge by suitable access pipes preferably with the inlet pipe 28 leading to the bottom and the outlet pipe 30 being located at the desired level of the surface of the electrolyte.

The invention has been described in detail with particular reference to preferred embodiments thereof, but it will be understood that variations and modifications can be effected within the spirit and scope of the invention.

I claim:

1. An electrode for an electrolytic cell comprising:

a frame of rigid plastic material having a hollow interior;

a sheet of porous support material on each side of said frame enclosing said hollow interior, said sheet of porous support material being flexible and being secured to said frame;

a plurality of fibers of electrically conductive material within said hollow interior, captured by said porous support material;

said electrode also comprising means connecting together said porous support material on opposite sides of said frame and acting to hold said fibers in place; and an electrical connector extending from said hollow interior to the outside of said frame, said connector being formed from said fibers.

2. An electrode in accordance with claim 1 wherein said fibers are carbon.

3. An array of electrodes for the electrolytic recovery of a metal from a solution containing ions thereof, comprising a plurality of electrodes in accordance with claim 1 arranged in spaced parallel relationship with one another; and a plurality of support rods of dielectric material extending between the frames and holding said electrodes in such spaced parallel relationship.

4. An electrolytic cell comprising:

a housing;

a plurality of electrodes in accordance with claim 1 arranged in spaced parallel relationship with one another and enclosed within said housing;

a plurality of support rods of dielectric material extending between the frames of said electrodes and holding said electrodes in such spaced parallel relationship; and means within said housing engaging at least some of said support rods and spacing said electrodes from said housing.

5. An electrolytic cell in accordance with claim 3, wherein said electrical connectors extend through said frames at the tops thereof.

6. An electrode in accordance with claim 1, wherein said frame, support material, and fibers are all combustible.

7. An electrode for an electrolytic cell comprising:

a frame of rigid plastic material having a hollow interior;

a sheet of porous support material having a portion on each side of said frame enclosing said hollow interior, said sheet of porous support material being flexible and being wrapped around the outside faces and edges of said frame;

a plurality of fibers of electrically conductive material within said hollow interior, captured between said portions of said sheet of porous support material;

said electrode also comprising means connecting together said portions of said sheet of porous support material on opposite sides of said frame and acting to hold said fibers in place; and an electrical connector extending from said hollow interior to the outside of said frame, said connector being in electrical contact with said fibers.

8. An electrode in accordance with claim 7 wherein said fibers are carbon.

9. An array of electrodes for the electrolytic recovery of a metal from a solution containing ions thereof, comprising a plurality of electrodes in accordance with claim 7 arranged in spaced parallel relationship with one another; and a plurality of plastic support rods extending between the frames and holding said electrodes in such spaced parallel relationship.

10. An electrolytic cell comprising:

a housing;

a plurality of electrodes in accordance with claim 7 arranged in spaced parallel relationship with one another and enclosed within said housing;

a plurality of support rods of dielectric material extending between the frames of said electrodes and holding said electrodes in such spaced parallel relationship; and means within said housing engaging at least some of said support rods and spacing said electrodes from said housing.

* * * * *